United States Patent [19]

Chang

[11] 4,286,451

[45] Sep. 1, 1981

[54] FORMING LEVELLER

[75] Inventor: William J. H. Chang, Rocky River, Ohio

[73] Assignee: The Yoder Company, Cleveland, Ohio

[21] Appl. No.: 49,491

[22] Filed: Jun. 18, 1979

[51] Int. Cl.[3] ..... B21C 1/02; B21C 5/14

[52] U.S. Cl. ..... 72/161; 72/177; 72/181; 72/165

[58] Field of Search ..... 72/161, 163, 164, 165, 72/177, 240

[56] References Cited

U.S. PATENT DOCUMENTS

| | | | |
|---|---|---|---|
| 2,323,768 | 7/1943 | Hanna | 72/165 |
| 2,708,958 | 5/1955 | Crafton | 72/161 |
| 3,289,448 | 12/1966 | Wiig | 72/163 |
| 3,499,305 | 3/1970 | Abernathy . | |
| 3,701,274 | 10/1972 | Reusch | 72/165 |

FOREIGN PATENT DOCUMENTS

| | | |
|---|---|---|
| 781843 | 2/1943 | Fed. Rep. of Germany . |
| 945838 | 7/1956 | Fed. Rep. of Germany . |
| 113703 | 6/1975 | German Democratic Rep. . |
| 928976 | 6/1963 | United Kingdom . |
| 1128102 | 9/1968 | United Kingdom . |

*Primary Examiner*—Milton S. Mehr

*Attorney, Agent, or Firm*—Maky, Renner, Otto & Boisselle

[57] ABSTRACT

A forming leveller establishes one or more datum or reference planes in variable thickness stock to facilitate subsequent roll forming. The reference planes may be established on the same side or opposite sides of the stock with a lateral gap to facilitate transition forming. The leveller includes top and bottom closely spaced roll sets forming multiple passes mounted on bottom and top frames, respectively, with floating rolls being opposed to fixed rolls. Back-up rolls are provided for the floating rolls and pressure devices urge the floating rolls against the stock in turn against the fixed rolls to form the desired reference planes thus enabling complex shapes to be roll formed from the variable thickness stock.

51 Claims, 13 Drawing Figures

20
21
22
23
25
26
27
28
29
30
31
32
34
35
41
42
45,46
47
54
55
57,58
60
61
72
73
74
75
76
77
78
79
80
81
82
83
138
146
160
161
168
171
173
174
176
177
180
181
183
184
185
187
188
191
192

FORMING LEVELLER

This invention relates generally as indicated to a forming leveller and more particularly to a forming leveller for establishing one or more reference planes in variable thickness stock to enable the stock to be subsequently roll formed.

The roll forming of variable thickness stock is at best difficult in that it is not generally possible closely to maintain constant dimensions. Moreover, product roll formed from such stock generally has a lack of linearity or what may be termed wavy surfaces due to the variable thickness of the stock. It is even more difficult to roll form variable thickness stock when the variable thickness extends on the opposite sides of the envelope of the section of the shape being formed or on opposite sides of required flat planar or reference surfaces.

Such variable thickness rolled sections have utility in the construction of air frames. For example, roll formed stringers need not be of the same thickness but may be of reduced thickness throughout portions of its length where the thicker portions are not required. The use of variable thickness stringers obviously results in less weight.

BACKGROUND OF THE INVENTION

Stock for the roll forming of variable thickness sections is usually made by one of two processes. By passing stock through a variable nip of forming rolls, symmetrically tapered stock is created. By symmetrically tapered stock, it is meant stock which enlarges symmetrically from the center or thinner portions of the stock to form the thicker portions. Symmetrically tapered stock also decreases in thickness symmetrically toward the center of the stock from each opposite side of the stock.

Another method of making stock for variable thickness roll forming is to lay a uniform thickness piece of stock on the bed of a milling machine and then mill away the top surface of the stock in areas where it is not needed. The latter is of course quite expensive and creates a reference plane or flat surface on one side only. Symmetrically tapered stock has no flat surface or reference plane. Symmetrically tapered stock, of course, has a multiplicity of planes, but none are oriented for roll forming to the required sectional shape.

The present invention is useful with stock either symmetrically tapered or milled as indicated above to convert the stock into stock having datum or reference planes which facilitate the roll forming of the stock to maintain closely the required constant dimensions and also to minimize the lack of linearity or wavy surfaces normally found in roll formed variable thickness stock.

SUMMARY OF THE INVENTION

With the present invention it is possible to take either symmetrically tapered stock or milled stock and successfully roll form it after passing it through the forming leveller of the present invention. The forming leveller is a multi-pass leveller which structurally forms or rather deforms the stock into stock having one or more reference planes. The reference planes are usually laterally separated by a transition section and may be on opposite sides of the stock or laterally offset and on the same side of the stock. There may be more than three reference planes depending upon the configuration of the section being rolled.

By bringing the stock to the reference planes prior to roll forming, it is then possible closely to maintain the required constant dimensions and also to minimize the wavy surfaces or lack of linearity which usually results from stock of variable thickness.

In order to provide such improved roll forming, a forming leveller is provided ahead of the roll forming mill and actually displaces the metal of the stock to the proper reference locations prior to roll forming. The forming leveller generates reference planes from otherwise multiple plane stock which multiple planes are not oriented for roll forming. In the case of symmetrically tapered stock, the forming leveller shifts the metal to at least one datum plane. The forming leveller of the present invention will also shift metal of symmetrically tapered stock at one portion of the width to one datum plane and at another portion of the width to still another datum plane. In the case of milled stock, the forming leveller will shift a portion of the width of a tapered stock having one datum plane to another datum plane or planes.

The forming leveller of the present invention utilizes fixed and opposed floating rolls with the fixed rolls of the multiple passes forming the datum planes. A constant gap is maintained between the floating rolls and the opposed fixed rolls regardless of the amount of offset setting for the range of variable thickness stocks. This precludes roll-to-roll contact protecting the rolls from running against each other.

The stock may vary in thickness continuously along the length sometimes with rapid rate of change. In order effectively to establish datum planes along every portion of the length, the roll passes must be very closely spaced only to be limited by the necessary physical sizes of rolls and shafts for rigidity. At least some of the fixed rolls are driven.

For each successive downstream pass, it is preferred that the rolls on one side of the stock be successively slightly larger in diameter in order to maintain or generate tension on the stock between the roll passes.

Both the fixed and floating rolls of each pass are provided with back-up rolls with the back-up rolls for the fixed rolls being fixed to preclude shaft deflection. The back-up rolls for the floating rolls, however, are urged toward the stock, up to the noted constant gap by high pressure spring means. Depending upon the nature of the stock and other design parameters, the mechanisms used to generate the spring pressure may vary. For high pressure requirements, hydraulics are preferred. However, metal springs or elastomeric springs may also be employed. The latter, while less expensive, are not as durable and would require more frequent replacement.

It is accordingly a principal object of the present invention to provide a forming leveller for a roll forming mill which enables the forming mill to maintain closely the constant dimensions required by the nature of the formed section of the variable thickness stock.

Another important object is the provision of a forming leveller for a roll forming mill which minimizes the wavy surfaces or lack of linearity normally encountered due to the variable thicknesses of the stock.

A further important object is the provision of a forming leveller which will displace the metal of the stock to a proper reference location prior to roll forming.

Another important object is the provision of a forming leveller which will generate dual datum planes from otherwise multiple plane stock which planes are not oriented for roll forming.

Another object is the provision of a leveller which will shift metal of a symmetrically tapered stock to at least one datum plane.

Another object is the provision of a leveller which will shift metal of a symmetrically tapered stock at one portion of the width to one datum plane and another portion to another datum plane.

Still another object is the provision of a forming leveller which will shift a portion of the width of a tapered stock already having one datum plane to yet another datum plane or planes.

Still another important object is the provision of a roll forming method utilizing a preformation of the stock to enable the stock to be rolled to maintain closely the constant dimensions and planarity of the variable thickness stock.

Other objects and advantages of the present invention will become apparent as the following description proceeds.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principle of the invention may be employed.

DETAILED DESCRIPTION OF THE INVENTION

Figure 1:
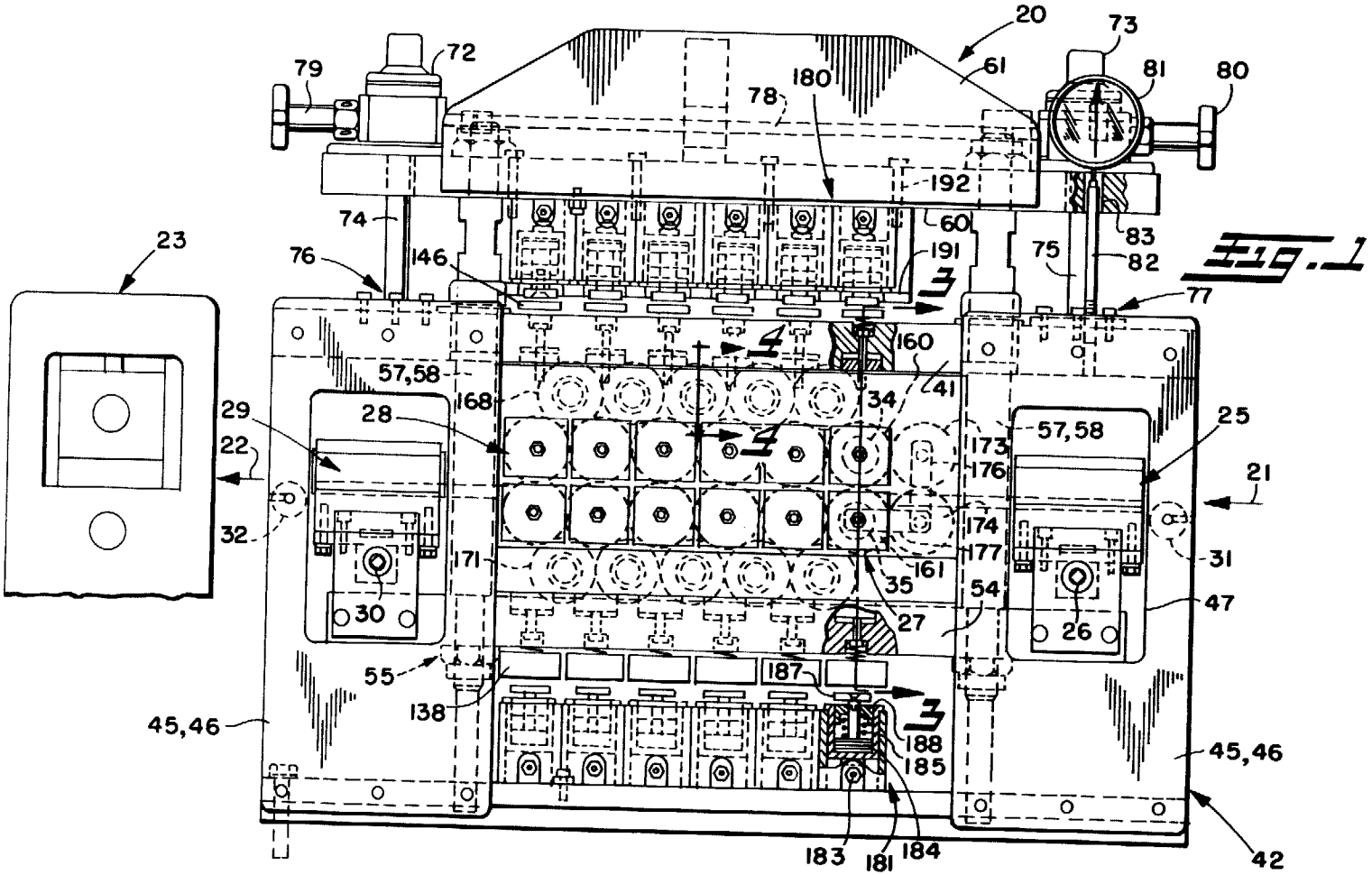
FIG. 1 is a side elevation partially broken away and in section of a forming leveller in accordance with the present invention positioned immediately ahead of the initial housing of the roll forming mill.

Referring first to FIG. 1 there is illustrated a forming leveller 20 in accordance with the present invention receiving cut to length sections of stock from the direction indicated by the arrow 21 to form the stock with the desired reference planes to exit the forming leveller as indicated at 22 to pass into the initial stand 23 of the forming mill. The stock initially passes through side guides 25 which may comprise sets of opposed vertically extending side guide rollers, the width setting of which may be adjusted at 26. The stock then passes through six successive roll passes, the initial one of which is shown at 27 and the final one being shown at 28. The now formed stock passes through side guide assembly 29, the setting of which is controlled at 30. A horizontally disposed entry roller is shown at 31 and a similar exit roller at 32.

Figure 2:
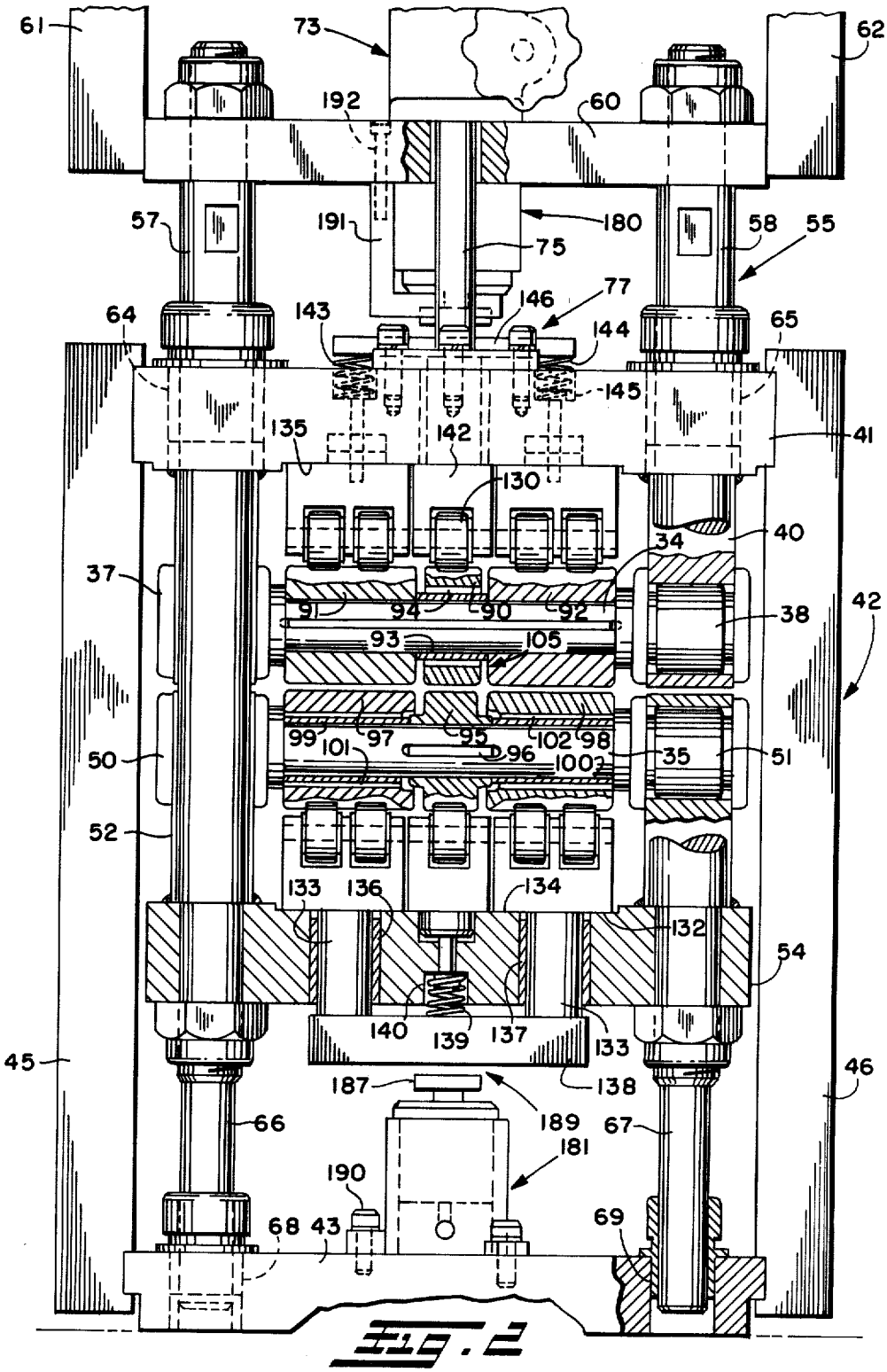
FIG. 2 is an enlarged end elevation of the forming mill, again partially broken away and in section illustrating the fixed bottom and movable top frames for the roll sets forming the multiple passes of the mill.
Figure 3:
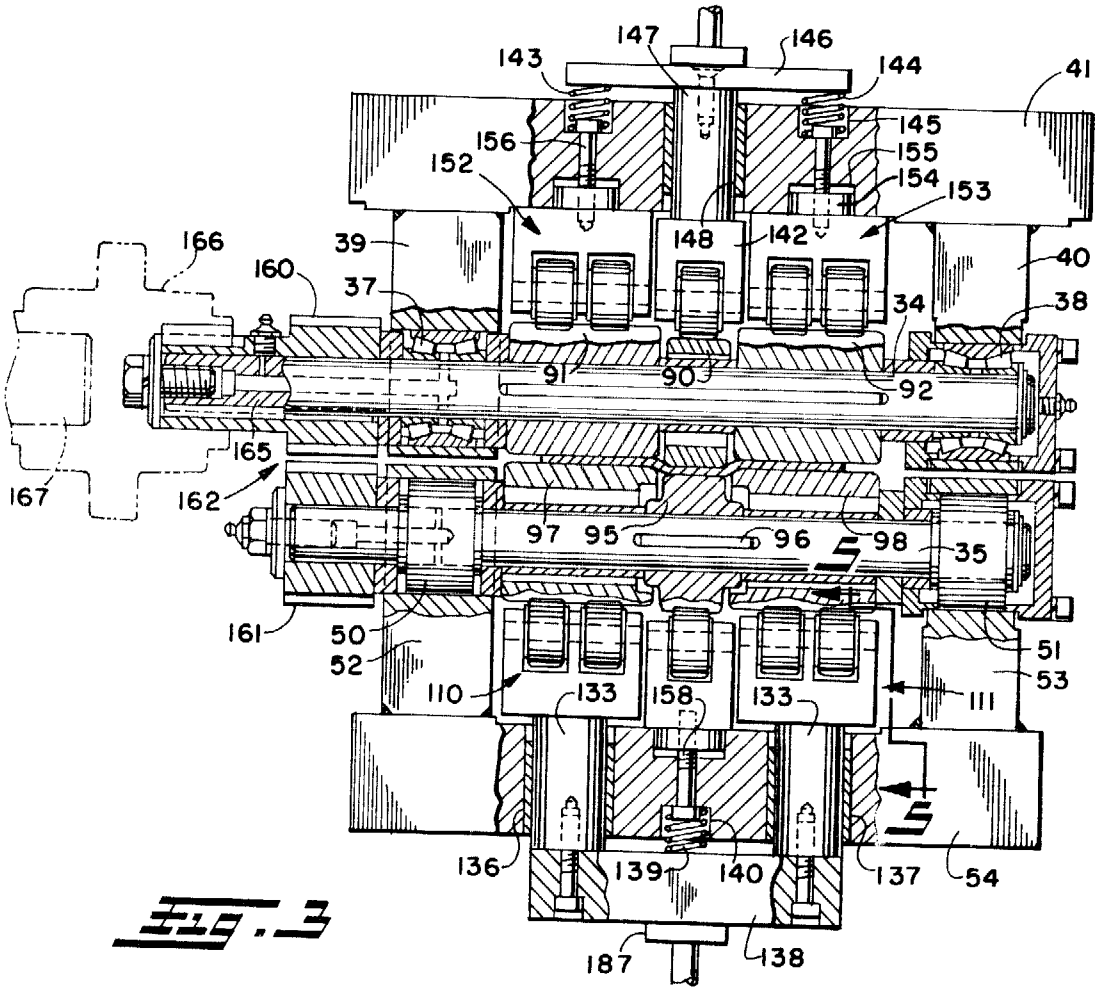
FIG. 3 is a further enlarged fragmentary vertical section taken substantially from the line 3—3 of FIG. 1 through the initial roll pass during reference plane levelling.

Referring now additionally to FIGS. 2 and 3, it will be seen that each pass comprises rolls mounted on opposed top and bottom shafts 34 and 35, respectively. There are accordingly, twelve main pass shafts, six on top and six opposed on the bottom.

The shafts 34 are journaled at 37 and 38 in side frame members 39 and 40, respectively, projecting downwardly from top frame member 41 of fixed bottom frame shown generally at 42.

The top frame member 41 is secured to and supported above base frame member 43 by the vertically extending side plates 45 and 46 at each end of the leveller, such side plates including the windows 47 providing access to the edge guides.

The frame just described, which supports the top shafts 34 of each pass, may be referred to as the fixed or bottom frame.

The bottom shafts 35 are journaled at 50 and 51 in frames 52 and 53, respectively, projecting upwardly from bottom frame member 54 of a vertically movable or top frame shown generally at 55. The bottom frame member 54 is secured to four vertically extending posts or rods as seen paired at 57 and 58 at each end of the frame. Secured to the top of the guide rods is a top horizontal frame plate 60 which includes two stiffening side plates 61 and 62.

Accordingly, the bottom frame 54 and the top frame 60 are rigidly interconnected by the rods 57 and 58. However, such rods are mounted for vertical sliding movement in the top fixed frame 41 as indicated by the bushings 64 and 65.

The lower ends of the rods seen at 66 and 67 in FIG. 2 project into bushings 68 and 69 in the bottom frame or base 63. The frame 55 may be termed a movable or top frame as opposed to the frame 42 which is termed a fixed or bottom frame.

Vertical movement of the top frame with respect to the bottom frame is obtained by two jacks seen at 72 and 73 which are mounted on the top of plate 60. The jacks include vertically movable posts 74 and 75, respectively, which project through holes in the plate 60 and are secured at 76 and 77, respectively, to the top of horizontal top fixed frame member 41.

The jacks are interconnected by line shaft 78 and accordingly both jacks may be adjusted simultaneously at either end by the hand wheel adjustments seen at 79 and 80. A dial indicator 82 is mounted on the top plate 60 and is engaged probe 82 secured to the top frame 41 of the fixed frame 42, such probe extending through hole 83 in the plate 60.

Accordingly, with the use of the adjustable jacks and the dial indicator, the position of the bottom shafts 35 of each roll pass may very closely be adjusted with respect to the fixed shafts 34.

ROLL ARRANGEMENT

Figure 7:
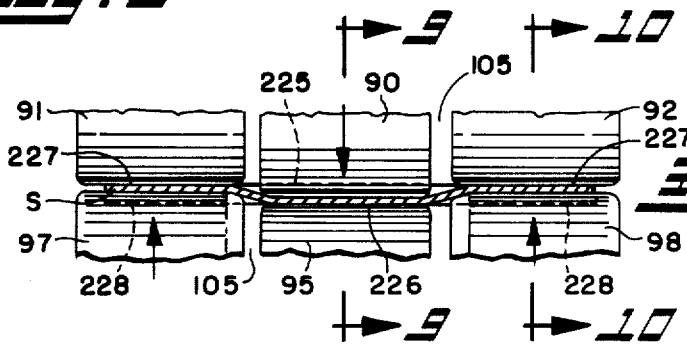
FIG. 7 is a schematic section through a pass of the forming leveller illustrating the relationship of the fixed and floating rolls to the stock.

Referring now more particularly to FIGS. 2, 3 and 7, it will be seen that each top shaft 34, in the illustrated embodiment, is provided with a center relatively narrow floating roll 90 and two substantially wider fixed rolls 91 and 92 on each side thereof. A sleeve or spacer 93 extends between the fixed rolls on which the floating roll is mounted. An air gap is provided between the floating roll and the spacer as indicated at 94.

The bottom shaft 35 of each pass is provided with a central somewhat narrower fixed roll 95 opposed to the floating roll 90 and is keyed to the shaft as indicated at 96. On each side thereof there is provided somewhat wider floating rolls 97 and 98 mounted on spacers 99 and 100, respectively, with air gaps 101 and 102 being provided between the floating rolls and the respective spacer.

As indicated, there may be a slight gap provided between the rolls as seen at 105 to permit the formation of a transition section between the reference planes being established. The gap may be provided by actually spacing the rolls as indicated or may be provided by rounding or crowning the corners of the rolls to permit the stock to change planes.

BACK-UP ROLL ASSEMBLIES

Figure 5:
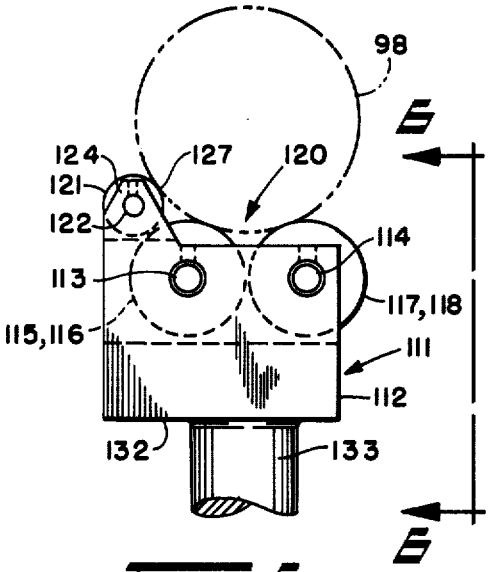
FIG. 5 is an enlarged broken away side elevation of a back-up roll assembly for a floating roll as seen from the line 5—5 of FIG. 3.
Figure 6:
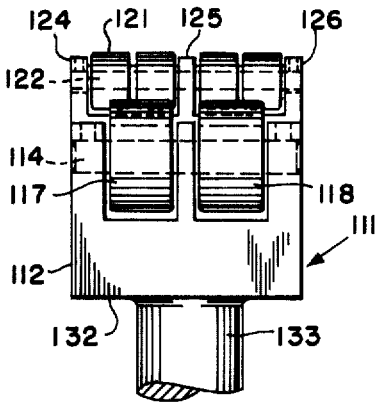
FIG. 6 is an elevation of such roll assembly as seen from the line 6—6 of FIG. 5.

Referring still to FIGS. 2 and 3 and in addition to FIGS. 5 and 6, it will be seen that each roll in each pass is provided with a back-up roll assembly. The back-up roll assembly for each fixed roll is fixed while the back-up roll assembly for each movable roll or floating roll is movable toward and away from the roll. The fixed rolls are backed up to avoid shaft deflection while the floating rolls are backed up to obtain the resilient force necessary to deform the variable thickness stock to the desired reference planes.

As seen in FIGS. 2 and 3, the somewhat wider floating rolls on the bottom shaft 35 are provided with back-up roll assemblies 110 and 111 which may be identical. Each includes a block type roll housing 112 supporting four main back-up rolls with two each being mounted on shafts 113 and 114. Backup rolls 115 and 116 are mounted on shaft 113 while back-up rolls 117 and 118 are mounted on shaft 114. The four back-up rolls thus provide a nest indicated at 120 in which the back-up roll is situated. The back-up rolls 115-118 are designed to be tangent to the periphery of the roll 98 and each simultaneously in contact therewith.

For each floating roll, there may be provided somewhat smaller downstream cage rolls indicated generally at 121. For the wider floating rolls there may be provided four such cage rolls. For the more narrow floating roll, only two will be provided. The cage rolls ae mounted on shaft 122 which extends through the three housing projections indicated at 124, 125 and 126. The cage rolls are not designed to run in contact with the floating roll but are provided with a slight clearance as indicated at 127. The cage rolls simply keep the floating roll where it belongs in the nest 120. Such cage rolls are provided on the back-up roll assemblies only for the floating rolls.

For the single floating roll on the top shaft 34, only two back-up rolls need be provided as indicated at 130 with two corresponding cage rolls.

Each roll housing for the back-up roll assembly includes a flat bottom or top as the case may be as indicated at 132 from which projects a cylindrical stem or rod 133. The flat upper or lower portion of the roll housing is designed to seat to close tolerance on the flat finished surface 134 of the top of vertically movable horizontal frame 54 or the underside 135 of the top frame member 41 of fixed frame 42.

As seen more clearly in FIG. 2, the stems 133 for the floating roll back-up roll housing project through bushings 136 and 137 in the frame 54 and are interconnected beneath the frame by yoke 138. A spring 139 in frame recess 140 urges the yoke downwardly to the extent permitted by contact between the surfaces 132 and 134.

The back-up roll housing 142 for the back-up rolls 130 for the top floating roll 90 is urged against the flat surface 135 of frame 41 by the springs 143 and 144 which are mounted in recesses 145 in the top frame 41 of the fixed frame 42. The plate 146 is secured to the upwardly projecting stem 147 of the back-up roll housing 142, such stem projecting through bushing 148 in the frame 41. Accordingly, the springs 143 and 144 urge the back-up roll housing 142 for the floating roll 90 upwardly to the extent permitted by contact between the back-up roll housing and the undersurface 134 of the frame 41.

Therefore, a force exerted upwardly on the yoke 138 or downwardly on the plate 146 will urge the back-up roll assemblies for the floating rolls and thus the floating rolls toward the stock.

The back-up roll assemblies 152 and 153 for the top fixed rolls 91 and 92 are provided with relatively shorter stems seen at 154 fitting in recesses 155 in the frame member 41 and are held in place by fasteners 156, the heads of which may be centered in the recesses 145 for the springs 143 and 144.

For the lower somewhat narrower fixed roll 95, the back-up roll assembly is similarly mounted by fastener 158 with the head of the fastener being centered in the recess 140 for the spring 139.

SHAFT DRIVES

Figure 4:
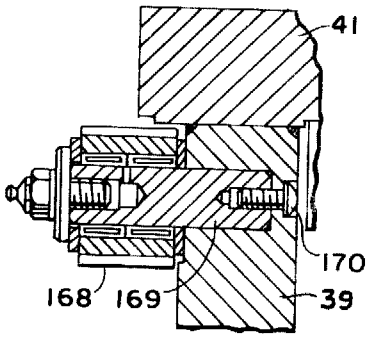
FIG. 4 is an enlarged vertical section of the idler gear assembly as seen from the line 4—4 of FIG. 1.

Referring now to FIGS. 1, 3 and 4, it will be seen that the shafts of each roll pass are rotated in the opposite direction with the top shaft of each pass rotating in a clockwise direction as viewed in FIG. 1 while the bottom shaft rotates in a counterclockwise direction. As seen in FIG. 3, each respective shaft is provided with a gear as seen at 160 and 161 which are provided with a clearance therebetween as seen at 162. One of the top shafts such as shaft 34 is provided with an extension 165 and the corresponding gear is also extended to be coupled at 166 to the output shaft 167 of a motor driven reducer. The gears on adjacent top shafts are drivingly interconnected by idler gears 168 journaled on stub shafts 169 secured to the frame members 39 by the fasteners 170 seen in greater detail in FIG. 4. The gears on adjacent shafts at the bottom of the passes are also interconnected by idler gears 171.

At the entry end of the roll passes, the gear 160 is in mesh with an idler gear 173 which is in turn in mesh with an idler gear 174 which is also in mesh with gear 161. The gear 174 may be held in mesh with both the gears 173 and 161 by the floating links seen at 176 and 177 holding the gear 174 in mesh with the gear 173 and 161, respectively.

In this manner a power drive to one of the shafts rotates all of the shafts in the desired direction at the same speed. As indicated previously, the successive rolls downstream on one side of the stock may each increase slightly in diameter to maintain the stock under tension as it moves through the forming leveller.

HYDRAULICS

For each of the two floating rolls at the bottom of each pass there will be a respective yoke 138 as seen more clearly in FIG. 1 and for each single floating roll at the top of each pass there will be a plate 146. Accordingly, for the six passes illustrated, there are six lower yokes 138 and six upper plates 146.

Associated with top plates 146 is a bank of hydraulic piston-cylinder assemblies shown generally at 180 and associated with yokes 138 is a further bank of hydraulic piston-cylinder assemblies shown generally at 181. There are six upper piston-cylinder assemblies 180 and six lower piston-cylinder assemblies 181 each vertically centered with respect to the respective plate 146 and yoke 138.

Each piston-cylinder assembly may be single acting with a spring return and hydralic pressure applied through the inlet port 183 causes the piston 184 to move toward the stock against the pressure of spring 185. The rod of each piston-cylinder assembly has secured to its projecting end a pad 187 which in the fully retracted position of the piston clears the respective yoke 138. At the rod of the piston-cylinder assembly there is provided a spacer 188 adapted to limit the stroke of the piston-cylinder assembly to provide the aforementioned gap precluding roll-to-roll contact in the absence of stock in the passes. The gap seen at 189 between the rod cap or plunger 187 and the respective yoke or plate permits the movable frame 55 to be adjusted vertically without affecting the function or operation of the hydraulic piston-cylinder assemblies. The bottom bank of hydraulic piston-cylinder assemblies 181 may be secured directly to the base frame 43 by the fasteners indicated at 190 while the upper bank 180 of hydraulic piston-cylinder assemblies may be supported on special L-shape brackets seen at 191 secured to the top frame plate 60 by the fasteners seen at 192.

The hydraulic cylinder 181 at full pressure react between the base 43 and the top shafts 34 of each pass which are supported and backed up by the top frame member 41 of the fixed frame 42. Likewise, the hydraulic cylinders 180 react between the top plate 60 and the bottom shafts 35 of each pass which are supported by the bottom frame member 54 of the movable frame 55. Accordingly, even at full hydraulic pressure there is no interframe force and accordingly no load on the jacks 72 and 73.

It will be appreciated that each of the six illustrated piston-cylinder assemblies may be provided with its own pressure control valve and gauge displaying to the operator the pressures achieved. However, in the illustrated embodiment only the piston-cylinder assemblies at the two initial passes may be controlled individually top and bottom while at the succeeding passes or passes 3-6, a single pressure setting may control both top and bottom piston-cylinder assemblies.

The Finished Product

Figure 9:
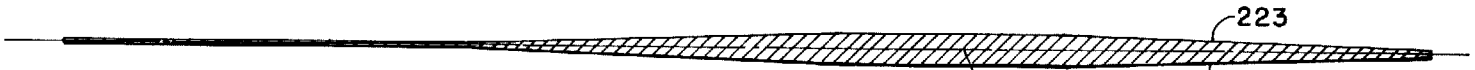
FIG. 9 is a longitudinal section taken on the line 9—9 of FIG. 7 showing the formation from such stock of one reference plane.
Figure 8:
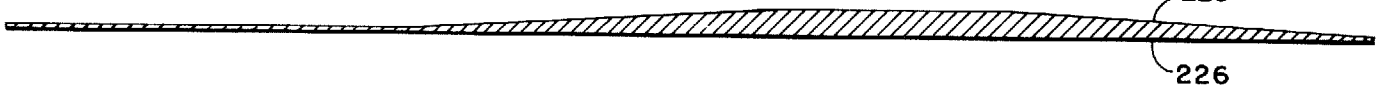
FIG. 8 is a somewhat schematic longitudinal section of typical symmetrically tapered stock pair to establishing the reference planes.
Figure 10:
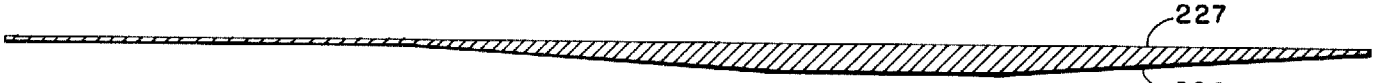
FIG. 10 is a longitudinal section taken on the line 10—10 of FIG. 7 showing the formation of another reference plane from such stock.

Referring now to FIG. 7 through FIG. 11; FIG. 7 shows schematically the transverse section of the stock as it is being processed to the reference or datum planes in the forming leveller of the present invention. FIG. 8 is a longitudinal section of the variable thickness stock of the symmetrically tapered type before it enters the leveller. In FIG. 8, 222 is the centerline of the stock while 223 is the top taper surface and 224 is the bottom taper surface of the stock. Surface 223 and 224 are essentially the same, but opposite hand to each other or symmetrical to the centerline. FIG. 9 is the longitudinal section of the stock excluding rolls as seen from line 9—9 at the center portion of FIG. 7. Similarly and corresponding, FIG. 10 is seen from line 10—10 at the righthand side or the lefthand side of FIG. 7. The purpose of the illustrated embodiment is to convert the top surface 223 of the entering stock as shown in FIG. 8 to the surface 225 of FIG. 9, having about twice as much rate of taper or angle as the initial surface 223 at one portion of the cross-section, and to convert the same top surface 223 to reference surface 227 of FIG. 10 having no taper at all on the other portion of the cross-section as seen at 10—10 of FIG. 7.

At the same time, the bottom surface 224 of the entering stock shown in FIG. 8 is converted to surface 226 with no taper at all as seen in FIG. 9, and to surface 228 of FIG. 10 having twice as much taper or angle as surface 224 in the original stock. The new datum planes established are top plane 227 of FIG. 10 and bottom plane 226 of FIG. 9. Such planes are shown in FIG. 7.

Figure 11:
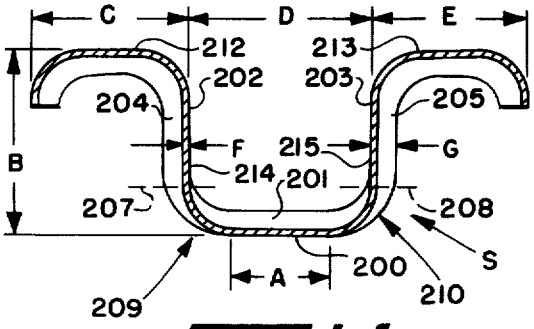
FIG. 11 is an enlarged transverse section of typical end product following roll forming.

FIG. 11 illustrates the finished section after it has passed through the forming mill. Although FIG. 7 and FIG. 11 are not to scale, the floating roll 90 and fixed roll 95 may have the approximate width of dimension A of FIG. 11 and the already established reference plane 226 of FIG. 7 will be roll formed as reference plane 200 of FIG. 11. The floating roll 90 permits the stock to vary in thickness on the opposite side of the reference plane as indicated at 225 of FIG. 9, or as seen at 201 in FIG. 11. The fixed rolls 91 and 92 establish the reference planes shown at 227 in FIG. 7 and FIG. 10, or as later to be roll formed to 202 and 203 of the finished work shown in FIG. 11. The stock on the opposite side of such reference plane 227, being variable in thickness, as indicated as 228 in FIG. 7, and after roll formed, at 204 and 205 in FIG. 11, is accommodated by the floating rolls 97 and 98.

Referring now to FIG. 7, the gaps 105 provided between the fixed and floating pairs of rolls serve as the transition zones between top datum plane 227 on two lateral sides of the section and the bottom datum plane 226 in the center portion of the section. The location of the transition zones is designed to match with the transition zones of the finished product as seen at 209 and 210 in FIG. 11, which is between the ends of dimension A and the tangent lines seen at 207 and 208.

Again, the dimension F is the minimum thickness of the stock and the dimension G is the maximum thickness. The gap provided by the spacers or stops in the piston-cylinder assemblies will be slightly less than the minimum dimension F.

The dimensions B, C, D, and E of the finished product are specified to be constant regardless of the stock thickness variation. However, the roll forming mill alone is inadequate to maintain the constancy of these dimensions. With the illustrated embodiment, the reference planes are established before the stock enters the forming mill and variations of the dimensions are thus minimized.

In addition to enabling the formation of the section such as seen in FIG. 11 to dimension tolerances required, the present invention also minimizes the waviness or lack of linearity which might be expected in the major top surface 212 and 213, the major inside surfaces of the section at 214 and 215, and also the major bottom surface established by the reference plane as seen at 200. The linearity of all these surfaces is influenced by how closely the taper stock surfaces are converted to straight plane surfaces as seen at 226 in FIG. 9 and 227 in FIG. 10. As it has been disclosed, the principal elements of the invention are closely spaced multiple passes of opposing floating and fixed rolls with tension in between.

It will be appreciated that a wide variety of finished product may be formed with the present invention with the reference planes established by the leveller shifting from one side to the other of the stock.

ALTERNATIVE PRESSURE PRODUCING EMBODIMENTS

Figure 13:
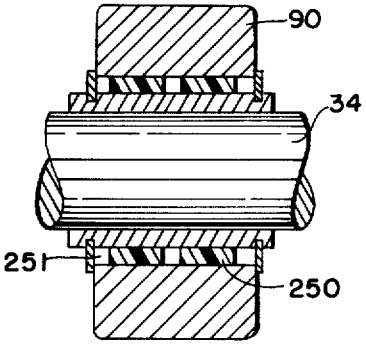
FIG. 13 is a fragmentary vertical section through a forming roll illustrating the use of elastomeric rings in the floating gap to provide the required resilience and spring pressure.
Figure 12:
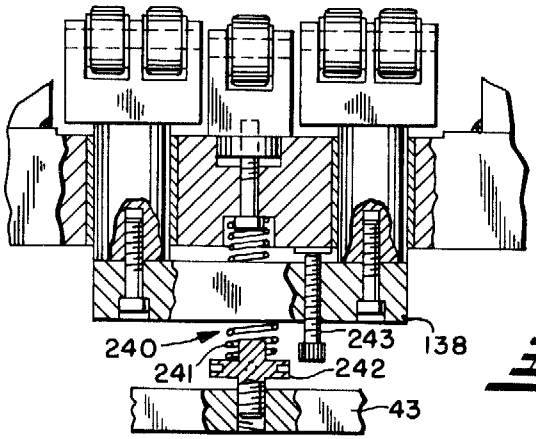
FIG. 12 is a fragmentary section of an alternative spring which may be used with the present invention.

Referring now to FIGS. 12 and 13, it will be seen that, although the hydraulic embodiment is preferred, other sources of high spring pressure may be employed with the present invention.

In FIG. 12 there is illustrated a coil spring system 240 provided between the bottom frame 43 and yoke 138. The coil spring 241 is adjustably mounted on stem 242 threaded in the frame 43. In such embodiment, the yoke 138 would bottom against the projecting end of adjustable stop 243 threaded in yoke 138 establishing the minimum gap desired. As the variable thickness portions of stock pass through the passes, the spring system illustrated yields and exerts a spring pressure on the stock to establish the reference plane against the opposite fixed roll.

In FIG. 13, elastomeric rings or sleeves 250 are employed in the floating gap 251 with sufficient lateral clearance for elastic deformation. The elastic rings simply maintain the roll 90 centered with respect to the shaft 34 at the established minimum gap and the variable thickness portions of the stock would cause the roll 90 to move eccentrically with resepct to the shaft against the spring pressure of the elastic deformation of the rings 250.

It can now be seen that with the present invention it is possible to maintain closely the major constant or envelope dimensions required by the nature of the shape being formed and also to minimize the lack of linearity or wavy surfaces normally encountered in the major surfaces of the shape.

With the present invention the forming leveller displaces the metal to the proper location prior to roll forming which enables the forming mill to do its job properly. The forming leveller generates one or more datum or reference planes from otherwise multiple plane stock which are not oriented to roll forming to the desired shape. This is particularly true in connection with symmetrically deformed stock in which the rolling mill computer controls the nip to vary the thickness, usually symmetrically about the centerline of the stock though only one of the nip rolls is moved. Thus the present invention displaces the metal of the stock to one or both sides with transition sections laterally in between. Accordingly, the present invention will shift the metal of a symmetricaly tapered stock to one datum plane or will shift the metal of a symmetrically tapered stock with a portion of the width to one datum plane and another portion to another datum plane. The present invention may also be used to shift a portion of the width of tapered stock having one datum plane such as the milled tapered stock to another datum plane or planes.

Other modes of applying the principle of the invention may be employed, change being made as regards the details described, provided the features stated in any of the following claims or the equivalent of such be employed.

I claim:

1. A multiple pass forming leveller for shaping variable thickness elongated stock to one or more planes of reference comprising a leveller having upper and lower fixed and floating stock engaging rolls at each pass, each floating roll being opposed to a fixed roll to compensate for variations in stock thickness.

2. A forming leveller as set forth in claim 1 including floating pressure means operative to urge the floating rolls toward said opposed fixed rolls to deform the stock to the reference planarity determined by the fixed rolls despite variations in stock thickness.

3. A forming leveller as set forth in claim 2 including back-up rolls for each stock engaging roll, and pressure means urging each back-up roll toward said respective floating roll to urge the latter into work engagement.

4. A forming leveller as set forth in claim 3 including a lateral gap between the fixed rolls on opposite sides of the stock to permit formation of transition sections longitudinally of the stock with the thickness variations extending in opposite directions on opposite sides of the transition section.

5. A forming leveller as set forth in claim 1 wherein at least some of the fixed stock engaging rolls ae power driven.

6. A forming leveller as set forth in claim 1 wherein each of the fixed stock engaging rolls are power driven and the driven rolls of each successive pass are slightly larger than the rolls of the preceding pass to maintain the stock under tension as it passes through the leveller.

7. A forming laveller as set forth in claim 2 wherein said floating pressure means comprise hydraulic cylinder assemblies urging said floating rolls into stock engagement.

8. A forming leveller as set forth in claim 7 including a single top floating roll and paired bottom floating rolls on opposite sides of the top floating roll, and individual hydraulic cylinders for each top floating roll and each paired bottom floating rolls.

9. A forming leveller as set forth in claim 7 including top and bottom hydraulic cylinders for the floating rolls at each pass of the leveller.

10. A forming leveller as set forth in claim 2 wherein said floating pressure means comprises elastomeric spring means.

11. A forming leveller as set forth in claim 2 wherein said floating pressure means comprises metallic spring means.

12. A forming leveller as set forth in claim 11 wherein said metallic spring means comprises a coil compression spring.

13. A forming leveller as set forth in claim 2 including stop means precluding floating roll, fixed roll contact in the absence of stock therebetween.

14. A forming leveller as set forth in claim 1 including means to adjust the upper and lower rolls with respect to each other to vary the distance between the reference planes.

15. A forming leveller as set forth in claim 14 wherein the upper rolls are mounted on a fixed frame, and the lower rolls ae mounted on a vertically movable frame.

16. A forming leveller as set forth in claim 15 wherein adjustable jack means extend between said frames for vertically moving the frame supporting the lower rolls.

17. A forming leveller as set forth in claim 16 wherein said movable frame projects above said fixed frame, said jack means extending between the top of said fixed and movable frames.

18. A forming leveller as set forth in claim 17 including two jack means, and means to move said jacks synchronously.

19. A forming leveller as set forth in claim 18 including vertical guide means interconnecting the bottom of said movable frame with the bottom of said fixed frame.

20. A forming leveller as set forth in claim 15 including pressure means for the upper and lower floating rolls mounted on the movable and fixed frames, respectively.

21. A forming leveller as set forth in claim 20 wherein said pressure means comprise vertically extending piston-cylinder assemblies mounted on the underside of the top of the movable frame and the top of the bottom of the fixed frame.

22. A forming leveller as set forth in claim 21 including back-up rolls for said floating rolls and respective spring loaded supports for said back-up roll adapted to be engaged by the rods of said piston-cylinder assemblies.

23. A forming leveller as set forth in claim 22 including a gap between the rod of each piston-cylinder assembly and the respective back-up roll support in the fully retracted condition of the rod.

24. A forming leveller as set forth in claim 1 including lateral guide means for the stock at the entrance and exit of the leveller.

25. A forming leveller as set forth in claim 3 wherein each back-up roll comprises at least two rolls nesting the stock engaging roll therebetween.

26. A forming leveller as set forth in claim 25 wherein the back-up roll for each floating roll includes a cage roll downstream thereof.

27. A forming roll as set forth in claim 26 including a slight clearance between the cage roll and respective floating roll.

28. A forming leveller as set forth in claim 1 wherein each pass includes at least two fixed rolls, each on opposite sides of the stock, such fixed rolls being laterally offset from each other and defining the reference planarity of the stock.

29. A forming leveller as set forth in claim 1 wherein each pass includes at least two laterally spaced fixed rolls, each on the same side of the stock.

30. A forming leveller as set forth in claim 1 wherein each pass includes at least two floating rolls, each on opposite sides of the stock, said floating rolls being laterally offset from each other.

31. A forming leveller as set fourth in claim 1 wherein each pass includes at least two laterally spaced floating rolls, each of the same side of the stock.

32. A forming leveller as set forth in claim 1 wherein such reference planes are on opposite sides of the stock and are laterally offset.

33. A forming leveller as set forth in claim 1 wherein said reference planes are on the same side of the stock but laterally offset.

34. A forming leveller as set forth in claim 33 wherein such reference planes on the same side of the stock are coplanar.

35. A stock leveller comprising a bottom set of stock engaging rolls and a top set of stock engaging rolls, shafts for the rolls of each set, a bottom fixed frame mounting the shafts of the top set of rolls and a top movable frame mounting the shafts of the bottom set for movement with respect to the top set.

36. A leveller as set forth in claim 35 wherein said top and bottom frames each include top and bottom frame members, the bottom frame member of the top frame being below the top frame member of the bottom frame.

37. A stock leveller comprising a bottom set of stock engaging rolls and a top set of stock engaging rolls, a bottom fixed frame supporting the top set of rolls and a top movable frame supporting the bottom set for movement with respect to the top set, said top and bottom frames each including top and bottom frame members, the bottom frame member of the top frame being below the top frame member of the bottom frame, and guide means interconnecting the bottom of each frame.

38. A leveller as set forth in claim 36 including adjustable jack means interconnecting the top of each frame.

39. A stock leveller comprising a bottom set of stock engaging rolls and a top set of stock engaging rolls, a bottom fixed frame supporting the top set of rolls and a top movable frame supporting the bottom set for movement with respect to the top set, said top and bottom frames each including top and bottom frame members, the bottom frame memeber of the top frame being below the top frame member of the bottom frame, at least two adjustable jack means interconnecting the top of each frame, and means to drive said jacks synchronously.

40. A stock leveller comprising a bottom set of stock engaging rolls and a top set of stock engaging rolls, a bottom fixed frame supporting the top set of rolls and a top movable frame supporting the bottom set for movement with respect to the top set, said top and bottom frames each including top and bottom frame members, the bottom frame member of the top frame being below the top frame member of the bottom frame, some rolls in each set being floating, and pressure means operative to urge the floating rolls toward the stock, said pressure means for the floating rolls of the top set being mounted on the top frame member of the top frame, and said pressure means for the floating rolls of the bottom set being mounted on the bottom frame member of the bottom frame.

41. A leveller as set forth in claim 40 wherein said pressure means comprise vertically extending piston-cylinder assemblies mounted on the underside of the top frame member of the top frame and the top of the bottom frame member of the bottom frame, respectively.

42. A leveller as set forth in claim 41 including back-up rolls for said floating rolls, and respective spring loaded supports for said back-up rolls mounted on the top frame member of the bottom frame and the bottom frame member of the top frame, respectively.

43. A leveller as set forth in claim 42 wherein said spring loaded supports are adapted to be engaged by the rods of said piston-cylinder assemblies.

44. A leveller as set forth in claim 43 including means to retract said rods clear of the respective back-up roll support.

45. A method of roll forming stock to a structural shape having variations in thickness with such variations extending on opposite sides of the stock comprising the steps of first form levelling such stock to one or more reference planes by displacing substantially all variations in the thickness to the side opposite the reference plane, and then roll forming such stock to the desired shape.

46. A method as set forth in claim 45 wherein such reference planarity is established by fixed rolls with floating rolls urging the stock thereagainst.

47. A method as set forth in claim 46 wherein such reference planarity includes two planes established by such fixed rolls.

48. A method as set forth in claim 47 wherein the planes established by such fixed rolls are on the same side of the stock but laterally offset.

49. A method as set forth in claim 48 wherein such planes on the same side of the stock are coplanar.

50. A method as set forth in claim 47 wherein such planes are on opposite sides of the stock and are laterally offset.

51. A method as set forth in claim 47 including leaving a gap laterally between such planes for transition roll forming.

* * * * *